United States Patent [19]

Peterson et al.

[11] Patent Number: 4,635,864

[45] Date of Patent: Jan. 13, 1987

[54] REFINER DISC SEGMENT

[75] Inventors: Per V. Peterson, Sundsvall; Hans E. Höglund, Matfors; Alf O. K. Johansson, Sundsvall, all of Sweden

[73] Assignee: SCA Development Aktiebolag, Sweden

[21] Appl. No.: 779,602

[22] Filed: Sep. 24, 1985

Related U.S. Application Data

[63] Continuation of Ser. No. 463,117, Feb. 2, 1983, abandoned.

[30] Foreign Application Priority Data

Feb. 3, 1982 [SE] Sweden ..... 8200614

[51] Int. Cl.[4] ..... B02C 7/12

[52] U.S. Cl. ..... 241/251; 241/261.3; 241/296

[58] Field of Search ..... 241/296, 297, 251, 261.3, 241/298, 261.2

[56] References Cited

U.S. PATENT DOCUMENTS 3,910,511 10/1975 Leider et al. ..... 241/261.3
4,023,739 5/1977 Lampe et al. ..... 241/296
4,039,154 8/1977 Peterson ..... 241/296 X

FOREIGN PATENT DOCUMENTS 0821624 4/1981 U.S.S.R. ..... 241/296

*Primary Examiner*—Mark Rosenbaum
*Assistant Examiner*—Joseph M. Gorski
*Attorney, Agent, or Firm*—Lerner, David, Littenberg, Krumholz & Mentlik

[57] ABSTRACT

Refiner disc segments for use in connection with disc refiners are disclosed. The refiner disc segments include in a radial portion thereof raised bars extending outwardly from the center of the segment with grooves defined between the raised bars, the raised bars having a width B, and the grooves having a width S and a depth D such that the ratio B·S·D/S+D is greater than about 2.7 mm and less than about 4.3 mm, and wherein the width B is from about 1 to 4 mm, the width S is from about 2 to 5 mm, and the depth D is from about 1 to 7 mm. Overall refining apparatus including a pair of refining members which include such refining disc segments are also disclosed as is a method for producing these refining disc segments.

12 Claims, 4 Drawing Figures

REFINER DISC SEGMENT

This is a continuation of application Ser. No. 463,117 filed 02/02/83, now abandoned.

FIELD OF THE INVENTION

The present invention generally relates to apparatus for refining fibrous material containing cellulose. More specifically the present invention relates to disc refiners for the mechanical processing of such cellulose material in which the refining surfaces include so-called refiner disc segments.

BACKGROUND OF THE INVENTION

In connection with the defibration and refining of cellulose-containing material so-called refiners are utilized, and they are often of the disc refiner type. These types of refiners are employed for the refining of cellulose and mechanical pulps of different kinds, particularly when it is desired to develop the paper forming properties of these materials by mechanical processing. All such defibration and refining includes the common characteristics that the desired results are achieved by processing the fibrous material while it is passing through the refiner. Such processing is achieved by the fibrous material, after having been fed into the refiner by various devices, passing out of the refiner through a narrow gap between two refining surfaces, which for this purpose are provided with refining members in the form of bars and intermediate grooves. Owing to the rotation of one and, at times, both said surfaces, the material is refined in the desired manner, and then transported out of the refiner by rotational forces. Specifically, U.S. Pat. No. 2,156,321 discloses a fibrous pulp refiner which specifies a particular width and depth for the grooves on the refining surface of the refining members (i.e., the refiner disc segments).

The intensity and nature of the processing of the fibrous materials are determined, for example, by the existence and number of bars and grooves which appear on the refining surfaces, and by the size of the gap between these surfaces. As a certain amount of wear of the refiner discs cannot be avoided, disc refiners are generally equipped with exchangeable refining members, or so-called refiner disc segments. These refiner disc segments are provided during their manufacture with a pattern and profile in accordance with the work to be carried out in the refiner. The energy required for defibration and refining is thus transferred to the fibrous material via the edges and surfaces of the bars.

It can therefore be stated that the design of the bars and grooves on these refiner disc segments is of importance for the energy consumption during the refining of cellulose material, especially at high concentrations, e.g., above about 20%. Even apparently small variations in the pattern of the refiner disc segments can thus cause considerable variations in the energy consumption therewith.

It is a shortcoming of the prior art that it does not disclose any relationship between the width of the bars and the width and depth of the grooves and the energy consumption of the refining process. In particular, specific prior art reference may only disclose a particular width and depth for the bars and grooves, but they do not teach any relationship between the width of the bars, the width and depth of the grooves, and the energy consumption of the refining process.

SUMMARY OF THE INVENTION

In accordance with the present invention, it has now been surprisingly discovered that the energy consumption can be substantially reduced when the refiner disc segments are designed so that the width of the bars, the width of the grooves, and the depth of the grooves, meet certain specified conditions.

In particular, and in accordance with this invention, it has now been discovered that these and other objects can be accomplished by means of refiner disc segments for providing at least a portion of the refining surface of a disc refiner rotatable about a central axis for refining fibrous material containing cellulose in which the refiner disc segment includes a portion corresponding to the central axis and a portion extending radially therefrom, and including in a predetermined radial portion thereof raised bars extending in a direction radially outward from the portion corresponding to the central axis, with grooves defined between those raised bars, the raised bars being of a predetermined width B and the grooves being of a predetermined width S and a predetermined depth D in the predetermined radial portion thereof, such that the ratio $B \cdot S \cdot D/S+D$ is greater than about 2.7 mm and less than about 4.3 mm, where the predetermined width B ranges from about 1 to 4 mm, the predetermined width S ranges from about 2 to 5 mm, and the predetermined depth D ranges from about 1 to 7 mm.

The present invention overcomes the disadvantages of the prior art in that the width of the raised bars and the width and depth of the grooves are determined by a relationship such that the energy consumption of the refining process will be reduced. The present invention discloses that the width of the bars and the width and depth of the grooves on the refining surface are important for the energy consumption required for refining the fibrous material. This is especially true when the fibrous material has a concentration of cellulose of at least about 20 percent. Indeed, the present invention discloses that even small variations in the dimensions of the raised bars and grooves disposed on the refining surface may cause considerable variations in energy consumption of the refining process. The present invention also discloses that the energy consumption of the refining process may be reduced substantially when the width of the raised bars and the width and depth of the grooves meet certain conditions.

In accordance with one embodiment of the present invention, the predetermined radial portion of the refining disc segment over which the raised bars and grooves are disposed may include the outermost portion of that portion of the refining disc segment extending radially from the portion corresponding to the central axis, or the outermost quarter of the surface area of the refining disc segment, measured by an axis of rotation extending from the portion of the refining surface corresponding to the central axis. It is also advantageous to the present invention that the grooves be substantially free of flow restrictions along their radial extent.

In accordance with another embodiment of the present invention, apparatus is provided for refining fibrous material containing cellulose including a pair of refining members relatively rotatable about a common axis with refining surfaces opposed to each other and at least one of the refining surfaces having over a predetermined radial portion thereof raised bars extending in the direction radially outward from the center of the refining surface with grooves defined between the raised bars. In this embodiment of the present invention the width B of the raised bars and the width S and depth D of the grooves again bear a relationship such that B·S·D/S·D is greater than 2.7 mm and less than 4.3 mm, where B ranges from about 1.0 to 4.0 mm, S ranges from about 2.0 to 5.0 mm and D ranges from about 1.0 to 7.0 mm.

In accordance with one embodiment of this aspect of the present invention, the predetermined radial portion of the refining surface over which the raised bars and grooves are disposed may again include the outermost portion of that refining surface, measured radially from the center thereof, or the outermost quarter of the surface area of the refining surface, measured by an axis of rotation extending from the center of the refining surface.

In order to maintain the particular dimensions of the raised bars and grooves over the surface of the refining disc segments thereof, it is necessary that the refining disc segment and the raised bars and grooves be manufactured of a material which is highly resistant to wear and corrosion. In a preferred embodiment, the present invention discloses an apparatus for the refining of fibrous material containing cellulose which is constructed of steel comprising the elements: C ranging from about 0.5 to 1.7 percent by weight, Si ranging from about 0.5 to 1.0 percent by weight; Mn ranging from about 0.3 to 0.8 percent by weight; Cr ranging from about 18.0 to 19.0 percent by weight; Ni ranging from about 1.0 to 2.1 percent by weight; and Mo ranging from about 0.7 to 1.0 percent by weight. As disclosed by the present invention, the steel used to construct the refining members and raised bars may also contain the element Ti ranging from about 1.0 to 5.0 percent by weight.

A further preferred embodiment of the present invention provides a method for producing the refining disc segments whereby a refining member is cast having a substantially planar surface, the surface is machine ground, and raised bars of a predetermined width and grooves of a predetermined width and a predetermined depth are formed by the process of spark machining. The methods of casting, machine grinding, and spark machining are all methods which are known in the art. This preferred embodiment may also include casting of the refining member from steel having the same composition as noted above as another preferred embodiment of this invention.

BRIEF DESCRIPTION OF THE DRAWINGS

Further objects, features and advantages of the present invention will become apparent from consideration of the following detailed description of the preferred embodiments, when reviewed in connection with the accompanying drawings, wherein.

DETAILED DESCRIPTION

Figure 1:
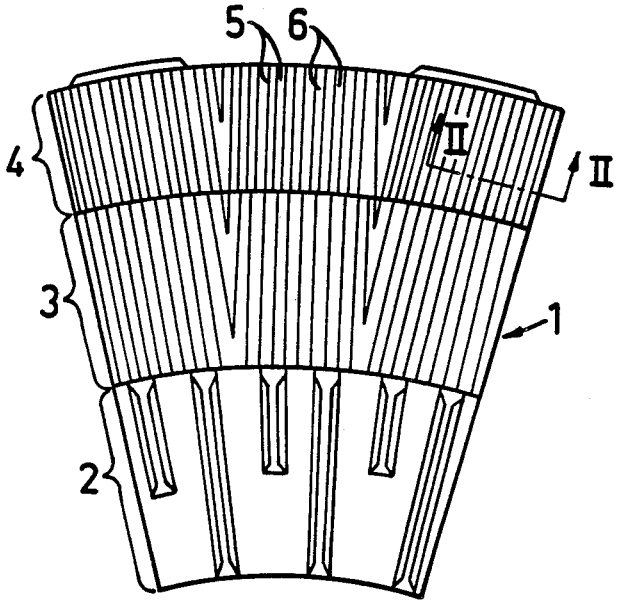
FIG. 1 is a top, elevational, perspective view of a refiner disc segment in accordance with the present invention.
Figure 2:
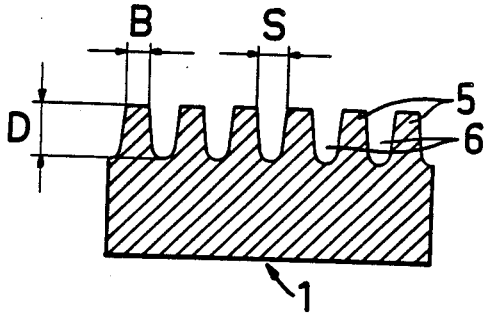
FIG. 2 is an elevational, perspective, cross-sectional view of a portion of the refiner disc segment of claim 1, taken along lines II—II of FIG. 1.

Referring to the figures, in which like numerals refer to like portions thereof, FIG. 1 shows a refiner disc segment 1 divided into first, second, and third zones, designated by reference numerals 2, 3 and 4, respectively, which are defined in a radial direction from the center of the refining surface, such that final processing takes place in the outer or third zone 4 thereof. As shown in FIG. 2, the design of the bars 5 and the grooves 6 are shown in detail therein, and the bar width, the groove width, and the groove depth, respectively, are designated by numerals B, S, and D, respectively.

In order to determine the relationship between the specific energy consumption and the pattern of the refiner disc segments, i.e., the design and location of the bars and grooves, specific refining experiments were carried out. In these experiments chips were refined in a disc refiner with counter-rotating refiner discs. The pulp concentration during refining was 33%, and the refining process was continued until the pulp had a quality corresponding to a Tensile index of 34 kNm/kg (Kilo Newton meter per kilogram). The production rate was varied within the range of 55 to 75 ADT/D (tons air-dry pulp per day), i.e., the production range normally utilized on an industrial scale.

It was realized that a good refiner disc segment should yield a specific energy consumption which is as low as possible, but that it is also important that the energy consumption not vary too much with the production rate.

The refiner disc segments which were tested were designed as those shown in FIGS. 1 and 2, and the individual tested segments, with respect to the dimensions B, S, and D, differed only with respect to the outer zone 4. In any event the outer zone 4 was free of flow restrictions, or so-called cross bars.

Figure 3:
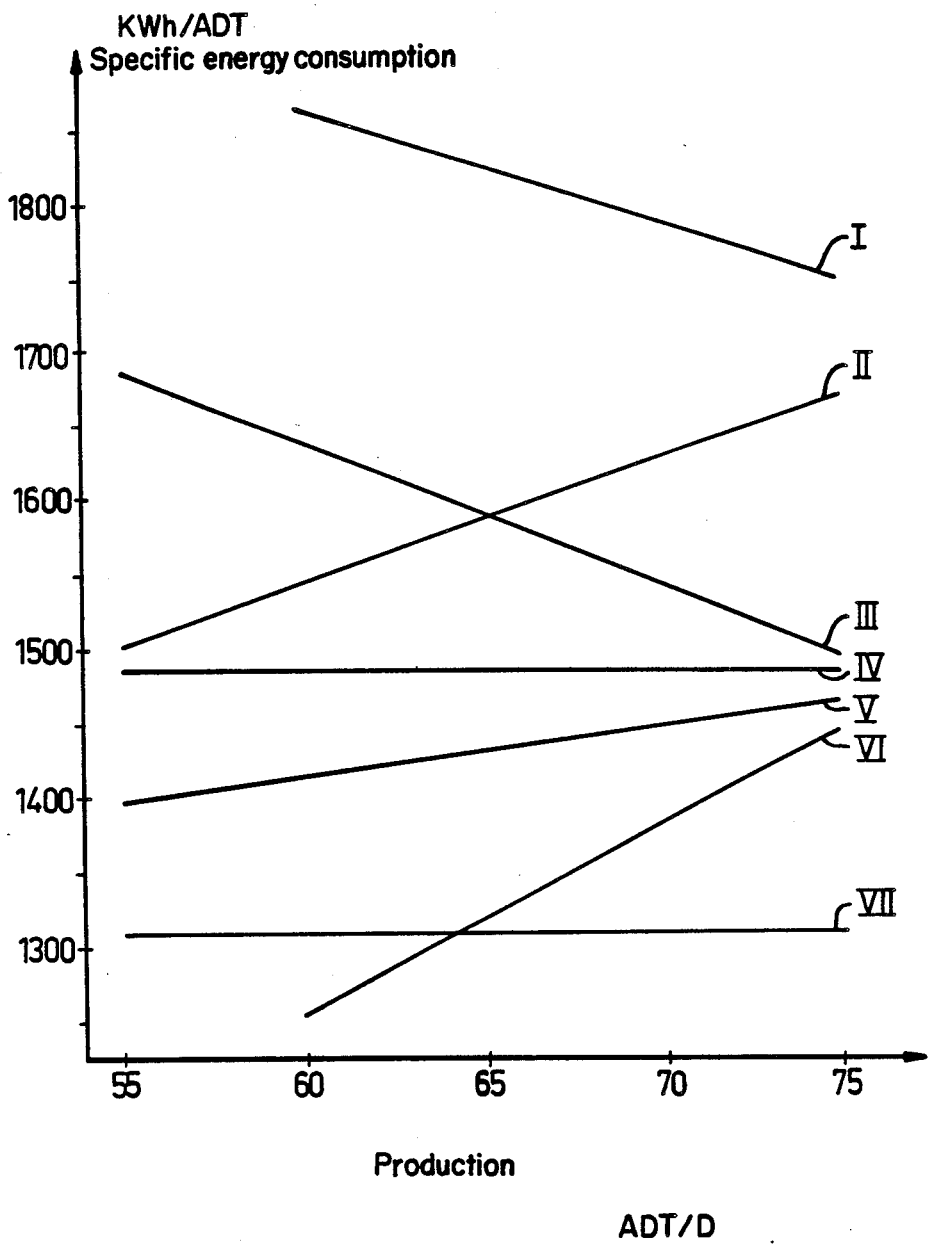
FIG. 3 is a graphical representation showing the energy consumptions for various refiner disc segments.

Referring now to FIG. 3, there is shown a graph demonstrating the relationship between the specific energy consumption at various production levels for different such refiner disc segments. The refiner disc segments are designated as I through VIII, and the tested segment designated by I represents a segment with an entirely conventional design of bars and grooves, i.e., in terms of the dimensions of B, S, and D. A normal energy consumption for such segments is about 1800 kWh/ADT at a pulp quality corresponding to about 34 kNm/kg, and is very strongly production responsive. The results obtained are shown in Table 1 below. The refiner disc segments II and III in the lower and upper portion of production interval, respectively, yielded reduced energy consumptions as compared to that of segment I. However, these results were strongly production responsive. The refiner disc segments IV through VIII, however, yielded specific energy consumptions of less than about 1500 kWh/ADT in the entire production interval. As is also shown in Table 1, the relationship B·S·D/S+D was calculated for each refiner disc segment I through VIII.

Figure 4:
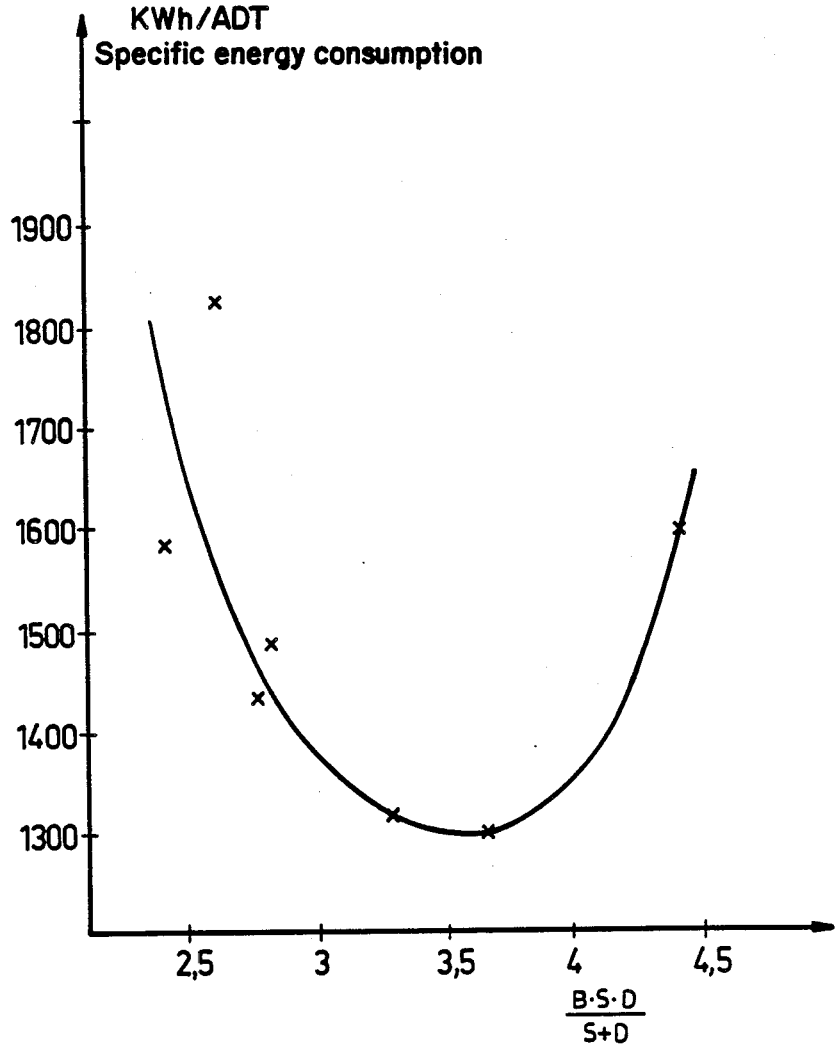
FIG. 4 is a graphical representation of the specific energy consumption for a particular refiner disc segment in accordance with the present invention.

Referring to FIG. 4, in which the relationship between the equation B·S·D/S+D was plotted against the specific energy consumption measured in WHT/ADT, the relationship B·S·D/S+D was calculated for the various refiner disc segments which were tested. As can be seen from these results, the specific energy consumption depends quite strongly on the calculated value of this relationship, and the energy consumption is a minimum when this relationship value is about 3.5 $mm^2$.

Furthermore, the value of this relationship must be between about 2.7 $mm^2$ and 4.3 $mm^2$ in order to yield a specific energy consumption of below about 1500 kWh/ADT. An additional improvement in the specific energy consumption can also be achieved by maintaining the relationship of B·S·D/S+D between about 3.0 $mm^2$ and 4.0 $mm^2$ as is also shown in FIG. 4. Furthermore, the width of the raised bars 5, represented by B may range from about 1 to 4 mm, the width of the groove 6, represented by S can range from about 2 to 5 mm, and the depth of the grooves 6, represented by D may range from about 1 to 7 mm.

It can therefore be seen that by designing the refiner disc segments according to the present invention it is possible to reduce the specific energy consumption below about 1500 kWh/ADT at the conditions set forth above.

In order to be able to maintain these conditions during the period of service of the refiner disc segments, it is essential that the refiner disc segments be manufactured of a material which is highly resistant to wear, corrosion and erosion. As an example of such a material, a steel with the following alloying elements can be employed:

| Alloying element | % by weight |
|---|---|
| C | 0.5–1.7 |
| Si | 0.5–1.0 |
| Mn | 0.3–0.8 |
| Cr | 16–19 |
| Ni | 1.0–2.1 |
| Mo | 0.7–1.0 |

In addition, the steel can include a certain amount of titanium, preferably about 1 to 5 percent by weight, in the form of very small titanium carbide grains.

The bars and grooves are usually formed in connection with the casting of these refiner disc segments. The processing surface of the bars can then be produced by surface grinding. It is not possible by such a manufacturing method, however, to achieve a high degree of accuracy for the dimensions of the bars and grooves across the refiner disc segment.

Since a high degree of dimensional accuracy is an essential requirement of the refiner disc segments of the present invention, another manufacturing method must therefore be applied. The refiner disc segments hereof are thus preferably manufactured as follows.

Initially, a blank in the form of a refiner disc segment with a smooth surface is cast. The blank is surface ground, and the pattern is then formed by machining so that bars and grooves with desired dimensions are obtained. This machining step is preferably carried out in the form of die spark-machining or deep grinding. Spark-machining is especially advantageous in connection with the machining of complicated recesses in hard and tough materials. When using the above-noted steel this machining method is therefore particularly suitable.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

What is claimed is:

1. An apparatus for refining fibrous material containing cellulose, said apparatus comprising a pair of refining members that are relatively rotatable about a common axis, each refining member having a refining surface that is opposed to the refining surface of the other refining member, each refining surface including an inner end that corresponds to said common axis, and an outer end, wherein said refining surfaces define a zone therebetween that extends radially outwardly relative to said common axis so that fibrous material passes through said zone; and further wherein at least one of said refining surfaces in a predetermined radial portion of said refining surfaces comprises a plurality of raised bars that extend radially outwardly with a plurality of grooves defined between said plurality of raised bars, each of said plurality of raised bars being of a predetermined width B, and each of said plurality of grooves being of a predetermined width S and a predetermined depth D in said predetermined radial portion, such that B·S·D/S+D is greater than 2.7 $mm^2$ and less than 4.3 $mm^2$, wherein said predetermined width B is between about 1.0 mm and about 4.0 mm, said predetermined width S is between about 2.0 mm and about 5.0 mm, and said predetermined depth D is between about 1.0 mm and about 7.0 mm.

2. The apparatus of claim 1, wherein said predetermined radial portion corresponds to said outer end of said refining surface.

3. The apparatus of claim 1, wherein said predetermined radial portion comprises an annular surface comprising the outermost one-fourth of said refining surface.

4. The apparatus of claim 1, wherein said grooves in said predetermined radial portion are substantially free of flow restrictions.

5. The apparatus of claim 1, wherein said refining members and said plurality of raised bars are constructed of steel comprising: C in an amount of between about 0.5 percent by weight and about 1.7 percent by weight; Si in an amount of between about 0.5 percent by weight and about 1.0 percent by weight; Mn in an amount of between 0.3 percent by weight and about 0.8 percent by weight; Cr in an amount of between about 16.0 percent by weight and about 19.0 percent by weight; Ni in an amount of between about 1.0 percent by weight and about 2.1 percent by weight; and Mo in an amount of between about 0.7 percent by weight and about 1.0 percent by weight.

6. The apparatus of claim 5, wherein said steel further comprises Ti in an amount of between about 1.0 percent by weight and about 5.0 percent by weight.

7. A refiner disc segment for a disc refiner rotatable about a central axis for refining fibrous material containing cellulose, said refiner disc segment including an inner portion corresponding to said central axis, a portion extending radially therefrom, and an outer end, and including in a predetermined radial portion thereof a plurality of raised bars that extend radially outwardly with a plurality of grooves defined between said plurality of raised bars, each of said plurality of raised bars being of a predetermined width B, and each of said plurality of grooves being of a predetermined width S and a predetermined depth D in said predetermined radial portion, such that B·S·D/S+D is greater than about 2.7 $mm^2$ and less than about 4.3 $mm^2$, wherein said predetermined width B is between about 1 mm and about 4 mm, said predetermined width S is between about 2 mm and about 5 mm, and said predetermined depth D is between about 1 mm and about 7 mm.

8. The refiner disc segment of claim 7, wherein said predetermined radial portion comprises an annular outermost portion of said portion of said refining disc segment extending radially from said portion corresponding to said central axis.

9. The refiner disc segment of claim 7, wherein said predetermined radial portion comprises an annular surface comprising the outermost one-fourth of said refining disc segment.

10. The refiner disc segment of claim 7, wherein said grooves in said predetermined radial portion are substantially free of flow restrictions.

11. The refining disc segment of claim 7, wherein said refining disc segment is constructed of steel comprising: C in an amount of between about 0.5% by weight and about 1.7% by weight; Si in an amount of between about 0.5% by weight and about 1.0% by weight; Mn in an amount of between 0.3% by weight and about 0.8% by weight; Cr in an amount of between about 16.0% by weight and about 19.0% by weight; Ni in an amount of between about 1.0% by weight and about 2.1% by weight; and Mo in an amount of between about 0.7% by weight and about 1.0% by weight.

12. The refining disc segment of claim 11 wherein said steel further comprises Ti in an amount of between about 1.0% by weight and about 5.0% by weight.

* * * * *